US006867672B2

(12) United States Patent
Vierling

(10) Patent No.: US 6,867,672 B2
(45) Date of Patent: Mar. 15, 2005

(54) SWITCHING DEVICE COMPRISING A LATCHING MECHANISM

(75) Inventor: Winfried Vierling, Neutraubling (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/483,395

(22) PCT Filed: Jun. 13, 2002

(86) PCT No.: PCT/DE02/02165

§ 371 (c)(1),
(2), (4) Date: Jan. 12, 2004

(87) PCT Pub. No.: WO03/007321

PCT Pub. Date: Jan. 23, 2003

(65) Prior Publication Data

US 2004/0245081 A1 Dec. 9, 2004

(30) Foreign Application Priority Data

Jul. 12, 2001 (DE) ..... 101 33 879

(51) Int. Cl.[7] ..... H01H 5/00; H01H 71/52

(52) U.S. Cl. ..... 335/166; 200/400; 200/325; 335/21; 335/26; 335/185; 337/56; 337/72

(58) Field of Search ..... 200/400, 401, 200/318–327, 332.1, 464, 457; 335/6–42, 132, 166, 167, 172, 175, 185–201; 337/51–56, 66.67, 70–72, 74, 75, 79

(56) References Cited

U.S. PATENT DOCUMENTS

| | | | | |
|---|---|---|---|---|
| 4,366,354 A | * | 12/1982 | Norden | 200/457 |
| 4,375,628 A | * | 3/1983 | Leonard | 337/75 |
| 4,617,540 A | * | 10/1986 | Westermeyer | 335/35 |
| 4,628,288 A | * | 12/1986 | Fujihisa et al. | 335/166 |
| 4,968,863 A | | 11/1990 | Rezac et al. | |
| 5,097,589 A | * | 3/1992 | Rezac et al. | 335/175 |
| 5,366,025 A | * | 11/1994 | Dutschk et al. | 173/109 |

FOREIGN PATENT DOCUMENTS

| | | |
|---|---|---|
| DE | 1904731 | 8/1970 |
| DE | 7500060 | 5/1975 |
| DE | 3031482 | 4/1982 |
| DE | 3339398 | 9/1985 |
| EP | 0144691 | 10/1984 |
| EP | 1096531 | 5/2001 |
| WO | WO 95/20235 | 7/1995 |

* cited by examiner

*Primary Examiner*—James R. Scott
(74) *Attorney, Agent, or Firm*—Harness, Dickey & Pierce P.L.C.

(57) ABSTRACT

A switching device includes a latching mechanism and is cheap to produce and easy to assemble. To this end, the construction is essentially formed from a three-part modular unit including metallic material, and has a spring which supports the back-latching of the latching mechanism, and forces which extend essentially in one plane in the latching mechanism.

8 Claims, 2 Drawing Sheets

SWITCHING DEVICE COMPRISING A LATCHING MECHANISM

This application is the national phase under 35 U.S.C. § 371 of PCT International Application No. PCT/DE02/02165 which has an International filing date of Jun. 13, 2002, which designated the United States of America and which claims priority on German Patent Application number DE 101 33 879.1 filed Jul. 12, 2001, the entire contents of which are hereby incorporated herein by reference.

FIELD OF THE INVENTION

The invention generally relates to a switching device having a latching mechanism.

BACKGROUND OF THE INVENTION

A switching device, in particular a protective switching device, having a latching mechanism is used, for example, as a circuit breaker. Circuit breakers—also referred to as automatic circuit breakers—are predominantly used today in place of fuses.

Circuit breakers are overcurrent circuit breakers having a first and a second tripping device which act on a latching mechanism. An electromagnetic tripping device effects instantaneous tripping in the event of a short circuit. A thermal bimetallic tripping device switches off in the event of permanent overloads when the affected line is excessively heated. The latching mechanism can also be actuated by a manually operable switching toggle, by which the respective circuit breaker can also interrupt a circuit.

A circuit breaker having a latching mechanism, which has a moveable contact arm, a tripping lever, a latch and two or more frame parts, is disclosed in U.S. Pat. No. 4,968,863. Forces occurring between the parts of the unit in this case run largely in one plane. The moveable contact arm and a torsion spring of the latching mechanism are in this case mounted on a pin such that they can pivot.

A mass-produced product such as a circuit breaker is subject to market-related and cost-restrictive factors which have a considerable effect on the number of components used in the device. The circuit breaker of the previously cited prior art does have, however, a number of device components which is unfavorable in respect of these factors.

Furthermore, a circuit breaker latching mechanism with a reduced number of parts is disclosed in DE 1 904 731. This latching mechanism has a unit which essentially includes a moveable contact arm, a tripping lever and a latch. In this case, the moveable contact arm is mounted on a pin.

An important criterion for the operational reliability of a circuit breaker is a so-called back-latching between the tripping lever and the latch. However, an element for assisting with this operation is not provided.

DE 33 39 398 A1 likewise discloses a circuit breaker having a latching mechanism. The latching mechanism has, at least in one section, a plastic part. The plastic part, however, owing to its proximity to the point of contact, must be made of a particularly durable and therefore expensive material.

SUMMARY OF THE INVENTION

An object of an embodiment of the present invention involves a switching device having a latching mechanism which solves at least one of the problems described above.

An object may be achieved according to an embodiment of the invention by a switching device.

A switching device of an embodiment of the invention includes an enclosure and a latching mechanism,

- the latching mechanism having a three-part unit having a tripping lever, a latch and a moveable contact arm,
- the unit essentially being formed from a metallic material, and
- the moveable contact arm forming, at one end, a joint with the latch via a connecting element,
- the moveable contact arm and the tripping lever being mounted on a deflection pin, fixed to the enclosure, such that they can pivot, and
- a spring, which assists the back-latching of the latching mechanism, surrounding the joint at a first end, bearing against the deflection pin, and acting on the tripping lever at a second end, and
- forces which act on the unit and occur between the components of the unit essentially running in one plane.

The cost-effective construction of a switching mechanism which can be achieved with an embodiment of the invention has a cost-reducing effect on the production of a switching device. This is provided, in particular, by the three-part unit of the switching mechanism, which is produced from simple, metallic, possibly single-material, stamped and bent parts. Furthermore, the fact that the contact arm and the tripping lever are mounted on a single pin contributes to the favorable production. The spring which improves the balance of forces and the back-latching is arranged or designed such that, on the one hand, it can follow the course of movement of the unit, and, on the other hand, it functions properly under a low prestress. There is no need for a further component to compensate for the occurrence of a tilting moment, since forces acting on the unit or occurring between the components of the unit are only effective in one plane.

Advantageously, the spring may be in the form of a leaf spring or round-wire spring such that a specific selection option is available, depending on the application and the type of switching device.

The forces which act on the unit and occur between the components of the unit advantageously run essentially in the plane of the moveable contact arm. A causal tilting moment producing friction losses and a tilting moment unfavorably influencing the balance of forces can accordingly be avoided.

BRIEF DESCRIPTION OF THE DRAWINGS

Further advantages, features and details of the invention will become evident from the description of illustrated embodiments given hereinbelow and the accompanying drawing, which is given by way of illustration only and thus is not limitative of the present invention, wherein.

In the text which follows, identical parts in the figures are provided with identical reference numerals or analogously with similar reference numerals.

DETAILED DESCRIPTION OF THE PREFERRED EMBODIMENTS

Figure 1:
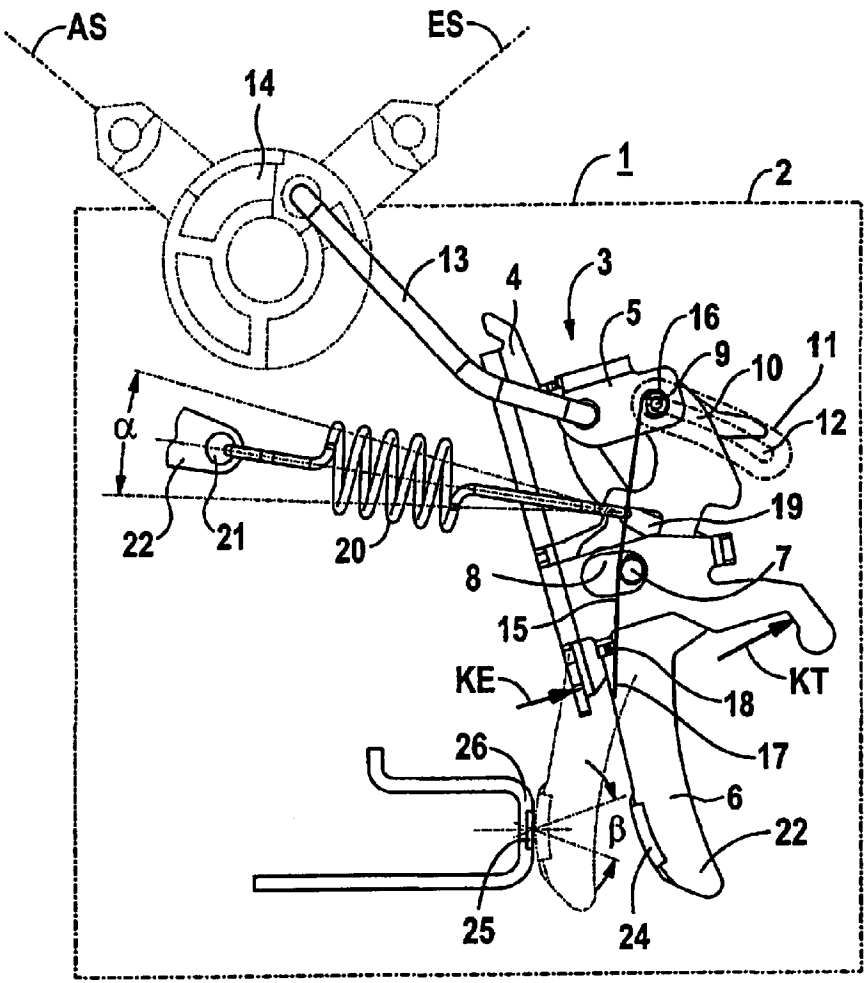
FIG. 1 shows a side view of a switching device having a latching mechanism in the off position.

FIG. 1 shows a switching device 1 having an enclosure 2 and a latching mechanism 3 in the so-called off position AS.

The latching mechanism 3 has a tripping lever 4, a latch 5, a moveable contact arm 6 and a deflection pin 7 fixed to the enclosure. The components latching mechanism 3, tripping lever 4 and latch 5 are formed from a metallic material, in particular from steel, brass, copper, bronze and/or brass, and from stamped and bent parts. In order to hold the components of the latching mechanism 3 together, in particular the tripping lever 4, the latch 5 and the contact arm 6, the tripping lever 4 and the latch 5 grip around the contact arm 6 and are connected to the contact arm 6 by the pushed-in deflection pin 7 and the bolt 9. The contact arm 6 has in this view an approximately mirror-reversed S shape and is provided approximately mid-way along its component length with a cutout 8, in which the deflection pin 7 is arranged.

The cutout 8 may be either open or closed and is directed essentially toward the tripping lever 4 with respect to the component width of the contact arm 6.

The cutout 8 is larger than the deflection pin 7, which simplifies the assembly of the device components. The cutout 8, in conjunction with the deflection pin 7, serves only to hold the device components together. The deflection pin 7 is arranged largely freely in the cutout 8 and performs, possibly in the form of a stop, a limiting or deflecting function.

The latch 5 is coupled at one end to a first end piece 10 of the contact arm 6 by way of a bolt 9 such that a joint is formed. The bolt 9 is for its part guided in an accommodating element 1, formed by the enclosure 2, such that it can be displaced. The accommodating element 11 may also be in the form of an arcuate link, the accommodating element 11 and possibly the link equally having an arced opening 12.

The accommodating element 11 may be in the form of both a molded-on part of the enclosure 2 and a separate enclosure part. The separate enclosure part may be arranged in the enclosure 2 such that its position can be altered, thus providing a large number of design possibilities. At the end opposite from the side coupled with a bolt at one end, the latch 5 is connected to a bracket 13, which in turn is operatively connected to a toggle drum 14. The enclosure 2, which may be made of insulating material, may include two enclosure shells, each having an accommodating element 11, the bolt 9 being guided on both sides.

The bolt 9 is surrounded by a spring 15, which assists the back-latching of the latching mechanism 3, at its first end 16. In the off position AS, the back-latching ensures that the latching mechanism 3 assumes a defined switching state. The spring 15 bears against the deflection pin 7 and its second end 17 acts on a protrusion 18 from the tripping lever 7. In the on position ES, the spring 15 counteracts any vibrations so as to prevent unwanted unlatching.

The spring 15, in this case in the form of a torsion spring, is mounted as it were freely at the joint and can follow the kinematics of the components of the latching mechanism 3. The torque produced by the spring in the on position ES is thus equal to the torque in the off position. The spring 15 may also be in the form of a leaf or round-wire spring as well as a torsion or spiral spring or have an equivalent construction.

Between the cutout 8 and the bolt 9, the contact arm 6 has an engagement opening 19 in which a tension spring 20 can engage. The tension spring 20 is also accommodated in an accommodating opening 21 in a holder 22 and thus is subject to prestress. The holder 22 can be mounted or displaced in a first angle range a such that, advantageously, different positions of the tension spring can have different contact forces, as a result of which definable types of switching device can be determined. On a second end piece 23 of the contact arm 6, a first contact piece 24 is arranged at approximately the same height as a second contact piece 25. The second contact piece 25 is placed on a stationary contact support 26, which is part of a unit not described in any more detail here.

In contrast to a conventional latching mechanism, the latching mechanism 3 has, in addition to the deflection pin 7, the accommodating element 11, which acts as a pivoting and swiveling element for the moveable contact arm 6. The moveable contact arm 6 is thus guided not by a combination of the deflection pin 7 and the cutout 8 but by the accommodating element 11, its opening 12 and the bolt 9 guided in said opening. The deflection pin 7 and the bolt 9 can, if appropriate, also be formed from a plastic.

If the toggle drum 14 is actuated so as to switch over from the off position AS to the so-called on position ES, which is indicated here roughly schematically, the toggle drum 14 transfers its rotational movement into a translational movement on the bracket 13. The bracket 13 in turn transfers the translational movement to the latch 5 and then the latter causes the contact arm 6, by way of the associated bolt 9, to carry out an arcuate swiveling movement. The first angle range $\alpha$, given by the variable holder 22, is mirrored by a second angle range $\beta$—determined by the kinematics of the latching mechanism 3—at the point at which the contact pieces 24, 25 touch.

Owing to the force effect of the tension spring 16, the tripping lever 4 pivots at the same time and to the same extent, and in the process is overlapped by the latch 5 to a greater extent. Advantageously, no tilting moments occur in this movement sequence, since forces acting on the unit or occurring between the components of the unit are only effective in one plane, in particular in the plane EK of the moveable contact arm 6. There is no need for a further component to compensate for the occurrence of a tilting moment. In order to introduce forces in one plane, a region on the tripping lever in which a stamped contour forms the latching point is bent into the central plane of the contact arm 6. The structural size AM, which reflects the profile thickness of this coherent and compact unit, may be between 2 and 20 mm, in particular 5 mm.

Figure 2:
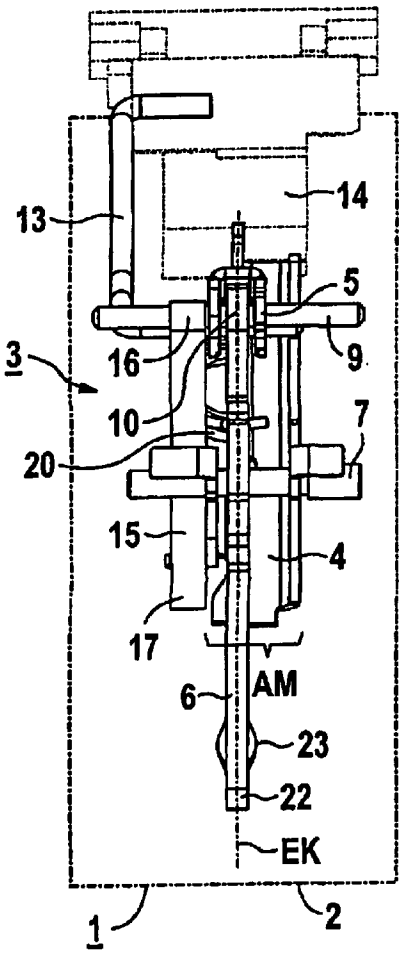
FIG. 2 shows a front view of a switching device as shown in FIG. 1.
Figure 3:
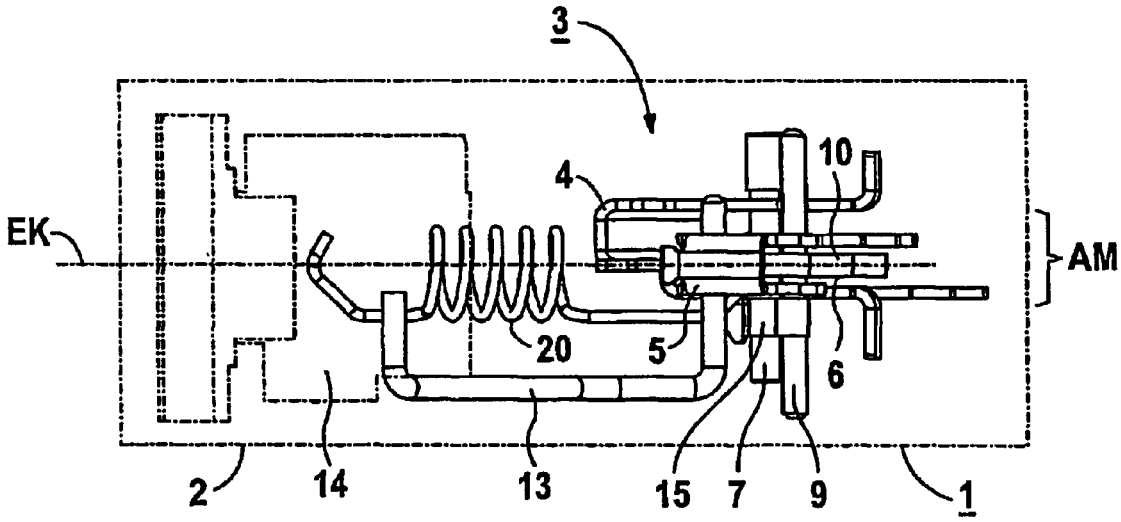
FIG. 3 shows a plan view of a switching device as shown in FIG. 1.

FIGS. 2 and 3 show a front view and a plan view, respectively, of the switching device 1 having the associated enclosure 2 and having the corresponding latching mechanism 3. For simplification purposes, the illustrations do not show the accommodating element 11, the holder 22 and the stationary contact support 26. The electromagnetic and thermal tripping devices mentioned initially produce, each in one tripping case, a first force KE and a second force KT, respectively, and these forces act on the tripping lever 4 and reset the latching mechanism 3 and thus the toggle drum 14 to the off position AS.

One concept of an idea of one embodiment is to achieve, by way of a favorable combination of the individual components of the latching mechanism 3 and the switching device 1, a considerable saving both in terms of the components and in the overall production of the latching mechanism 3. The overall latching mechanism 3 may be produced and in particular assembled in an automated fashion. This also relates to the insertion of the spring in the latching mechanism 3, which considerably simplifies the process. The overall construction is further distinguished by a virtually "free suspension" of the latching mechanism 3 in the enclosure 2, since, on the one hand, it only bears against the deflection pin 7, and, on the other hand, it is guided in the opening 12 such that it can move. The forces produced by the spring 15 essentially only act between elements of the latching mechanism 3.

Exemplary embodiments being thus described, it will be obvious that the same may be varied in many ways. Such variations are not to be regarded as a departure from the spirit and scope of the present invention, and all such modifications as would to be obvious to one skilled in the art are intended to be included within the scope of the following claims.

What is claimed is:

1. A switching device, comprising:

an enclosure;

a latching mechanism;

a three-part unit including a tripping lever, a latch and a moveable contact arm; wherein the unit is essentially formed from a metallic material; wherein the moveable contact arm forms, at one end, a joint with the latch via a connecting element; and wherein the moveable contact arm and the tripping lever are being pivotably mounted on a deflection pin fixed to the enclosure; and a spring, adapted to assist in back-latching of the latching mechanism, surrounding the joint at a first end, bearing against the deflection pin, and adapted to act on the tripping lever at a second end; wherein forces which act on the unit and occur between the components of the unit essentially in one plane.

2. The switching device as claimed in claim 1, wherein the spring is in the form of at least one of a leaf and a round-wire spring.

3. The switching device as claimed in claim 1, wherein the forces which act on the unit and occur between the components of the unit run in the plane of the moveable contact arm.

4. The switching device as claimed in claim 2, wherein the forces which act on the unit and occur between the components of the unit run in the plane of the moveable contact arm.

5. A switching device, comprising:

a three-part unit including a tripping lever, a latch and a moveable contact arm, wherein the moveable contact arm forms, at one end, a joint with the latch and wherein the moveable contact arm and the tripping lever are pivotably mounted on a deflection pin; and a spring, surrounding the joint at a first end, bearing against the deflection pin, and adapted to act on the tripping lever at a second end, wherein forces which act on the unit and occur between the components of the unit essentially run in one plane.

6. The switching device as claimed in claim 5, wherein the spring is in the form of at least one of a leaf and a round-wire spring.

7. The switching device as claimed in claim 5, wherein the forces which act on the unit and occur between the components of the unit run in the plane of the moveable contact arm.

8. The switching device as claimed in claim 7, wherein the forces which act on the unit and occur between the components of the unit run in the plane of the moveable contact arm.

* * * * *